US008162010B2

(12) United States Patent
Pagani

(10) Patent No.: US 8,162,010 B2
(45) Date of Patent: Apr. 24, 2012

(54) CIRCULAR FILLING MACHINE PARTICULARLY FOR SLENDER AND ELONGATED PRODUCTS

(75) Inventor: Caterina Pagani, Parma (IT)

(73) Assignee: Zanichelli Meccanica S.p.A., Parma (IT)

( * ) Notice: Subject to any disclaimer, the term of this patent is extended or adjusted under 35 U.S.C. 154(b) by 423 days.

(21) Appl. No.: 12/453,639

(22) Filed: May 18, 2009

(65) Prior Publication Data

US 2009/0288375 A1 Nov. 26, 2009

(30) Foreign Application Priority Data

May 26, 2008 (EP) ..... 08425373

(51) Int. Cl.

| | |
|---|---|
| ***B65B 1/20*** | (2006.01) |
| ***B65B 1/28*** | (2006.01) |
| ***B65B 3/18*** | (2006.01) |
| ***B65B 3/22*** | (2006.01) |

(52) U.S. Cl. ..... 141/71; 141/72; 141/146; 53/525

(58) Field of Classification Search ..... 141/71, 141/72, 74, 144–147, 73; 53/525, 257, 236, 53/253, 255

See application file for complete search history.

(56) References Cited

U.S. PATENT DOCUMENTS

| | | | | |
|---|---|---|---|---|
| 2,644,629 | A * | 7/1953 | Orrie | 141/146 |
| 4,168,599 | A * | 9/1979 | King | 53/471 |
| 4,646,509 | A | 3/1987 | Tribert | |
| 5,041,297 | A * | 8/1991 | Dowaliby | 426/397 |
| 5,762,113 | A * | 6/1998 | Ricossa et al. | 141/78 |
| 5,987,859 | A * | 11/1999 | Dreger | 53/544 |
| 7,284,574 | B2 * | 10/2007 | Fontaine et al. | 141/72 |
| 2009/0288375 | A1 * | 11/2009 | Pagani | 53/525 |

FOREIGN PATENT DOCUMENTS

| | | |
|---|---|---|
| EP | 0 195 428 A | 9/1986 |
| FR | 2 312 409 A | 12/1976 |
| GB | 440 658 A | 1/1936 |
| WO | 95/03970 A | 2/1995 |

* cited by examiner

*Primary Examiner* — Dinh Q Nguyen
*Assistant Examiner* — Jennifer Gordon
(74) *Attorney, Agent, or Firm* — Modiano & Associati; Albert Josif; Daniel O'Byrne

(57) ABSTRACT

A circular filling machine particularly for slender and elongated products, comprising a carousel assembly which supports a plurality of filling funnels which can be inserted in corresponding containers supported by transfer pans, the filling machine further comprising vibration elements for the funnels, vibration elements for the containers, and a tamping assembly for the insertion and final packing of the product in the containers.

6 Claims, 8 Drawing Sheets

CIRCULAR FILLING MACHINE PARTICULARLY FOR SLENDER AND ELONGATED PRODUCTS

The present invention relates to a circular filling machine particularly for slender and elongated products.

BACKGROUND OF THE INVENTION

As is known, volumetric circular filling machines are used typically to fill loose products, such as peas, beans, meat cubes, carrots, peppers and the like, in containers which can be of any type.

In the solutions of the background art, circular filling machines have optimum operation with loose products which do not have an elongated shape and can provide considerable precision in dosage and great reliability in operation.

The slender products, such as for example so-called "difficult" products, which have an elongated shape, such as string beans, turnip slices, strips of peppers or carrots and so forth, increase in volume significantly and tend to create jamming, thwarting the precision of the dosage.

Such difficulties are further increased in the case of products with a particularly elongated extension, which occupy a large volume which is not constant with respect to the weight, requiring extended and substantial settling in order to be able to achieve an acceptable packing of the product inside the container.

SUMMARY OF THE INVENTION

The aim of the invention is to solve the problem described above by providing a circular filling machine particularly for slender and elongated products which allows to obtain filling with constant doses of the products, with the possibility to insert precisely and uniformly the product within the container.

Within this aim, an object of the invention is to provide a circular filling machine which does not damage the product during dosage steps, avoiding formation of clogging which would thwart the dosage of the product and make it uneven.

Another object of the present invention is to provide a circular filling machine which, thanks to its particular constructive characteristics, is capable of giving the greatest assurances of reliability and safety in use.

Still another object of the present invention is to provide a volumetric circular filling machine which can be obtained easily starting from commonly commercially available elements and materials and is also competitive from a merely economical standpoint.

This aim and these and other objects which will become better apparent hereinafter are achieved by a circular filling machine particularly for slender and elongated products, comprising a carousel assembly which supports a plurality of filling funnels which can be inserted in corresponding containers supported by transfer pans, characterized in that it comprises vibration means for said funnels, vibration means for said containers, and a tamping assembly for the insertion and final packing of the product in said containers.

BRIEF DESCRIPTION OF THE DRAWINGS

Further characteristics and advantages will become better apparent from the description of a preferred but not exclusive embodiment of a circular filling machine particularly for slender and elongated products, illustrated by way of non-limiting example in the accompanying drawings, wherein.

DESCRIPTION OF THE PREFERRED EMBODIMENTS

Figure 1:
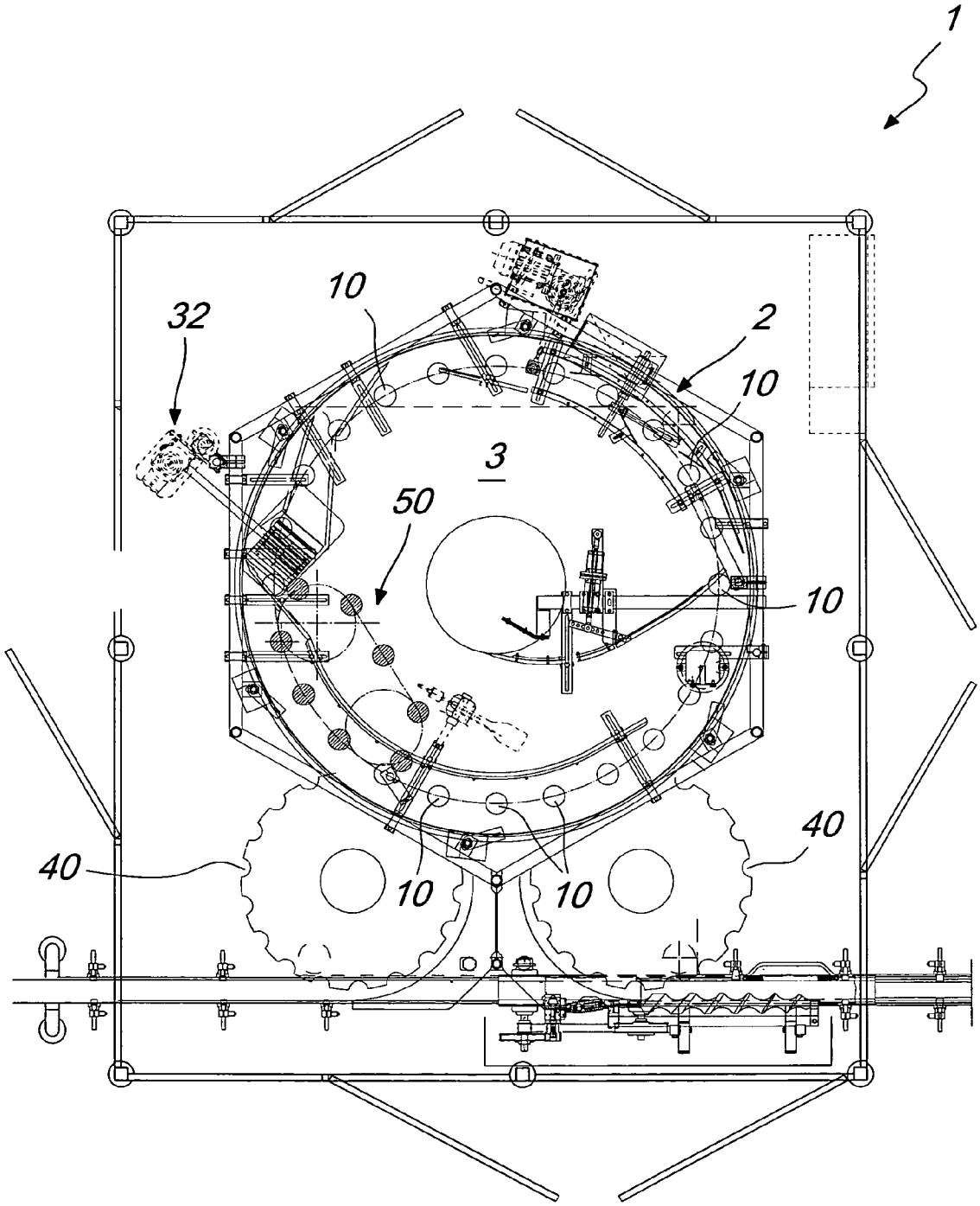
FIG. 1 is a top plan view of the circular filling machine.

With reference to the figures, the circular filling machine particularly for slender and elongated products, according to the invention, generally designated by the reference numeral 1, comprises a carousel assembly 2 which forms in an upward region a tray 3 for containing the product to be dosed.

On the carousel 2 a plurality of funnels 10 are provided, which are arranged so as to correspond to pans 11 for supporting containers 12, which in each instance are positioned below the funnels.

In order to adjust the filling volume, means for varying the penetration of the funnels in the container are provided, thus adjusting the dosed volume at will.

Figure 2:
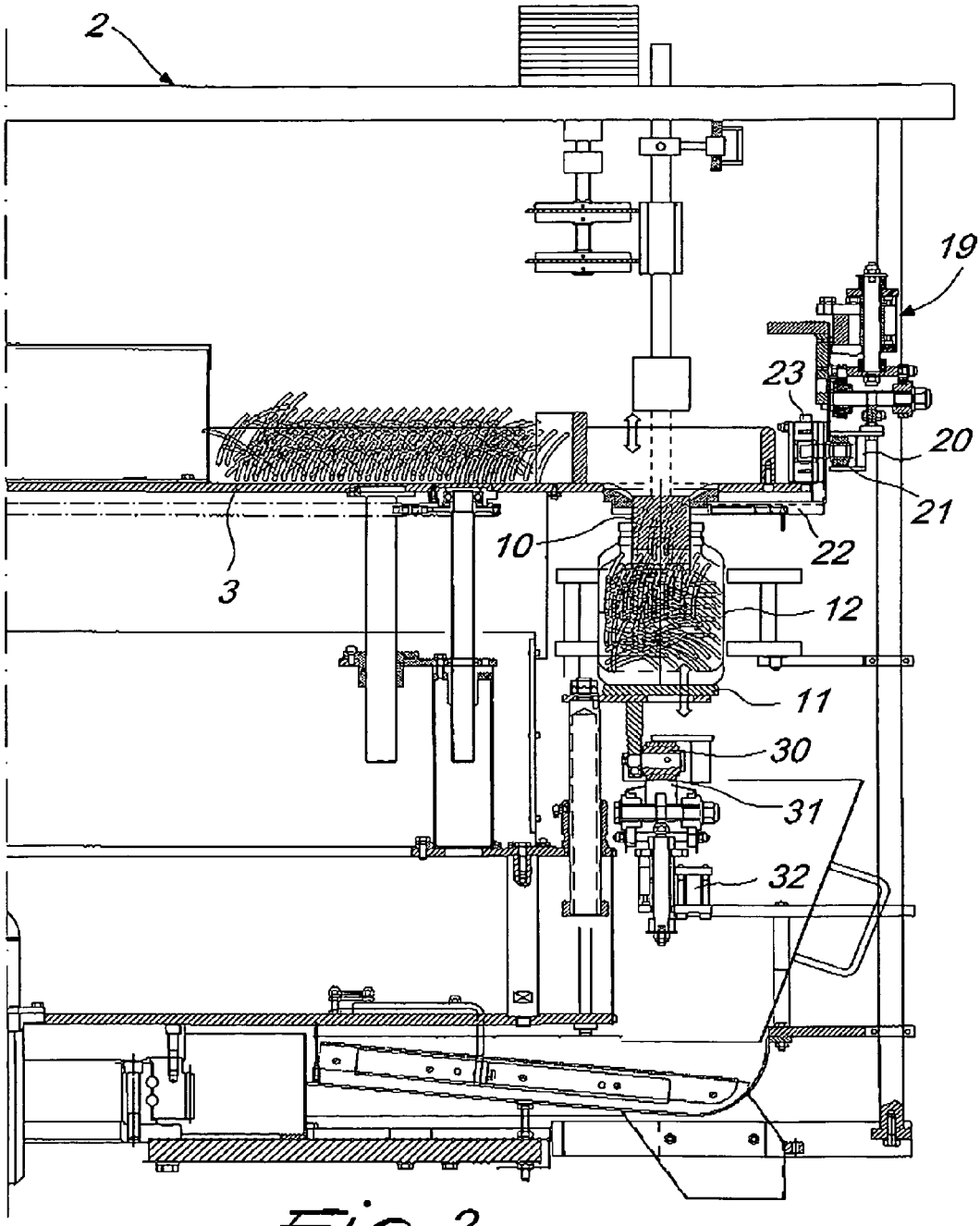
FIG. 2 is a sectional view, taken along a vertical plane, of the filling funnels and of the supporting pan of the container.
Figure 3:
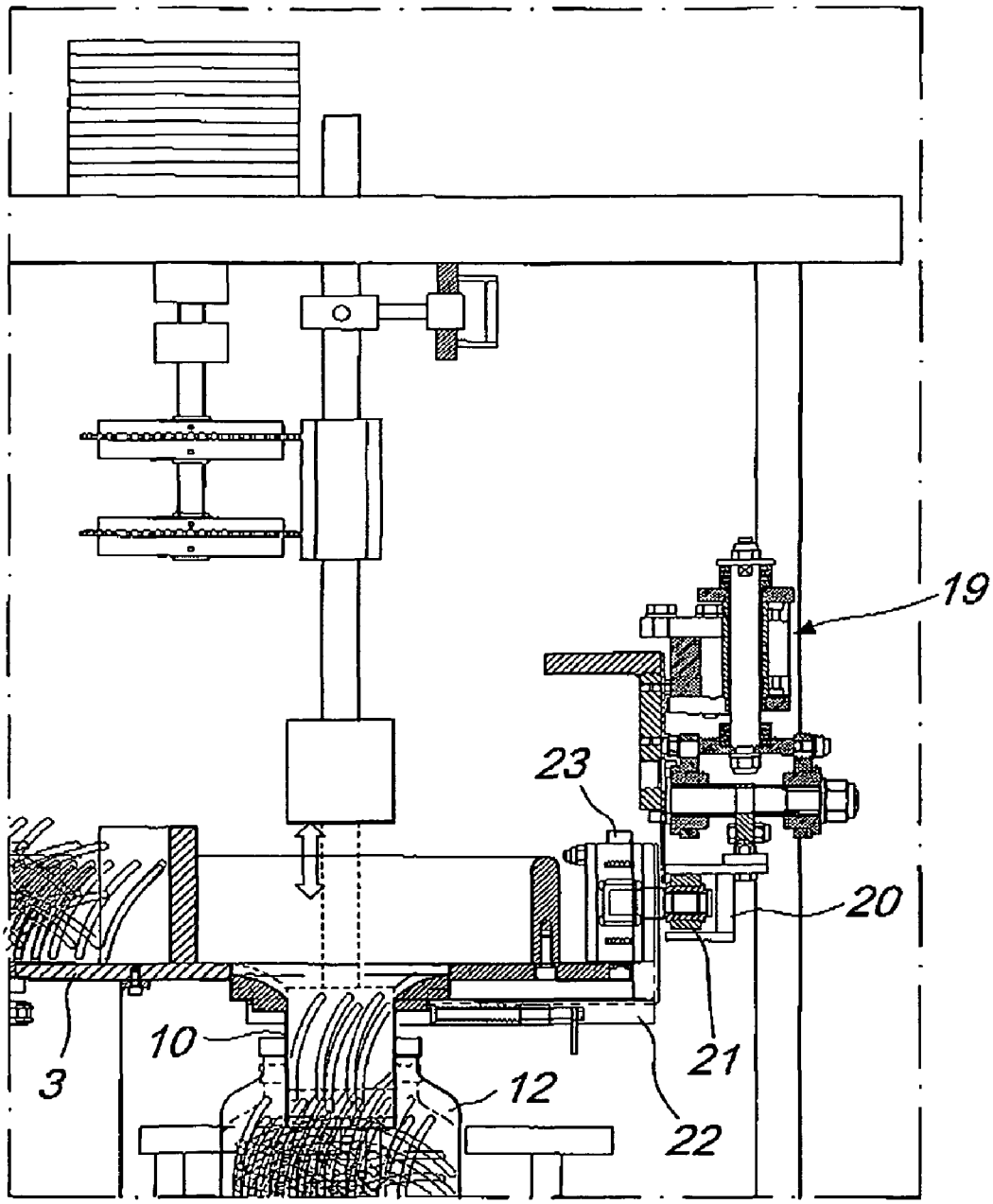
FIG. 3 is a view of a detail of the vibration means of the filling funnels.

A peculiarity of the invention consists in that means for vibrating the funnels in order to facilitate entry are provided and are constituted, as shown more clearly in FIG. 2, by sectors which are associated with the carousel and can be adjusted independently of each other.

Each sector is connected to vibrating units 19 of the type disclosed in Italian patent No. 0001382718, assumed included herein by reference, which vibrate a cam 20 with which rollers 21 of the funnels engage which are connected by means of a bracket 22 to the funnels 10, by way of the possibility of reciprocating translational motion with respect to a support 23 provided on the carousel tray 3.

In this manner, a funnel is subjected, in the selected manner, to vibration along an alternating direction which is proximate to the axis of said funnel.

The vibration of the funnels is able to cause the descent into the funnel, and consequently into the container, of slender products, such as string beans, sticks of carrots, turnips and so forth, which would normally behave like a spring, stopping between the walls of the funnel, without being able to be transferred to the container, and of products which are not slender but hard and elongated, such as for example cucumber.

Figure 4:
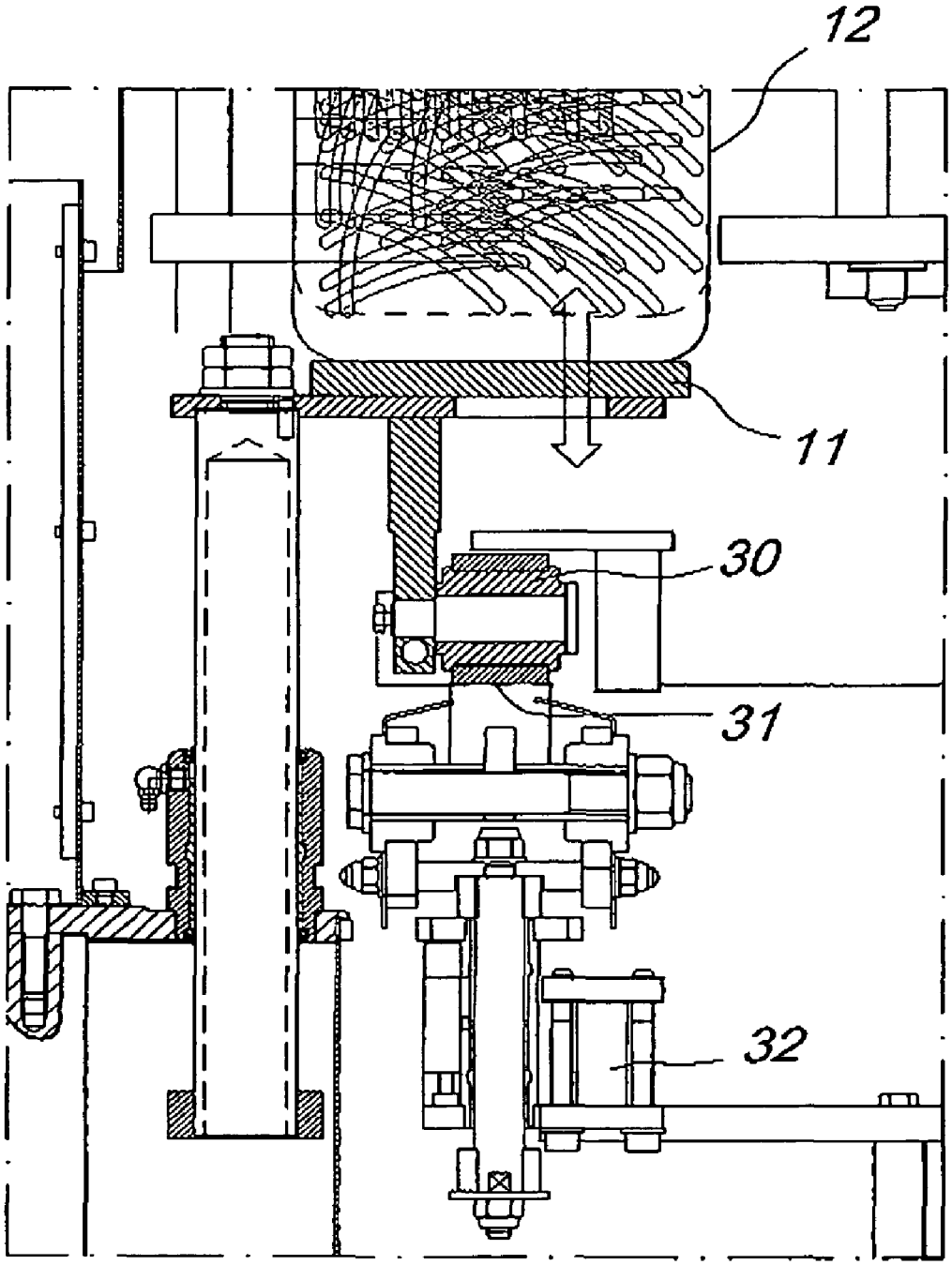
FIG. 4 is a view of a detail of the vibration means of the containers.

The funnels, as mentioned earlier, are inserted in the containers 12, positioned on the individual pans 11, which are provided with vibration means for the containers, shown more clearly in FIG. 4, which have a cam follower roller 30 connected to the pan 11 and connected to the corresponding sector 31, which is made to vibrate by means of vibration assemblies, designated by the reference numeral 32, and also of the type shown in the previously cited Italian patent No. 0001382718.

Each sector 31, which defines the pan sliding plane, vibrates the rollers 30 connected to the pan lifters provided to allow the considerable stroke that the container must perform in order to allow the filling funnel 10 to enter the container 12, centering itself precisely and vertically, which would not be possible to achieve by using a classic rising and descending profile provided by a simple sliding plane.

The vibration is transmitted by the vibration assemblies 32, which are independent of the vibration units 19 used for the funnels, so as to obtain in practice the composition of two effects which combine with a synergistic action.

A particular feature of the invention is constituted by the fact that after transferring the largest possible quantity of product to the container, by way of the vibration of the container and of the funnels, a part of the product remains in any case within the funnel and is unable to descend by gravity but has to enter the container to fill the empty spaces and thus be able to reach the desired weight.

Specifically, at the end portion of the filling machine, upstream of the output star conveyor, designated by the reference numeral 40, there is a tamping assembly 50, which affects only a portion of the holes provided on the filling machine, such portion depending on the dimensions and production rate of the machine.

The tamping assembly is moved by a motor which is synchronized with the filling machine, but synchronization is determined by the position of the tamping element that is inserted in the corresponding funnel.

Figure 5:
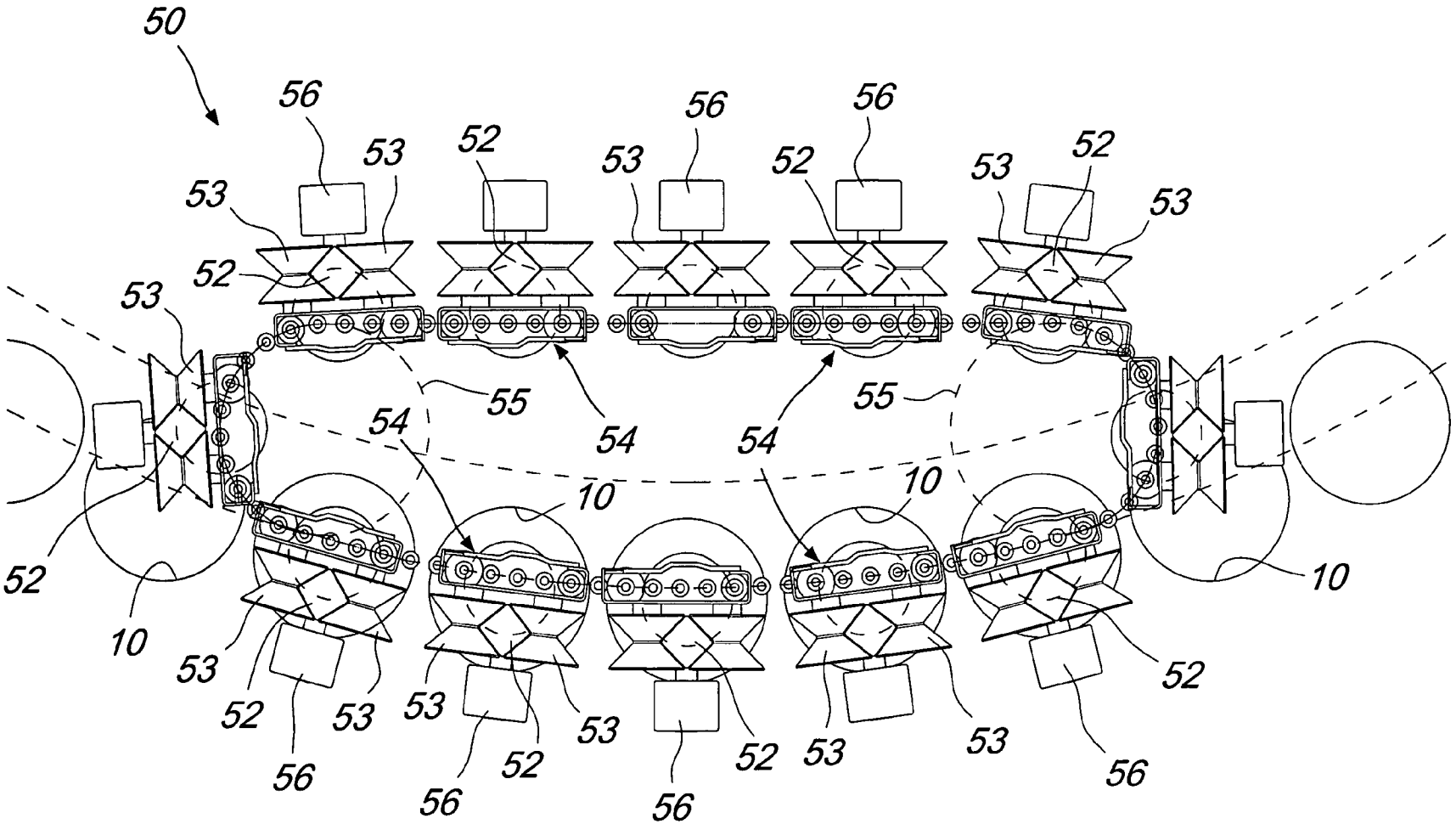
FIG. 5 is a top plan view of the tamping assembly.
Figure 6:
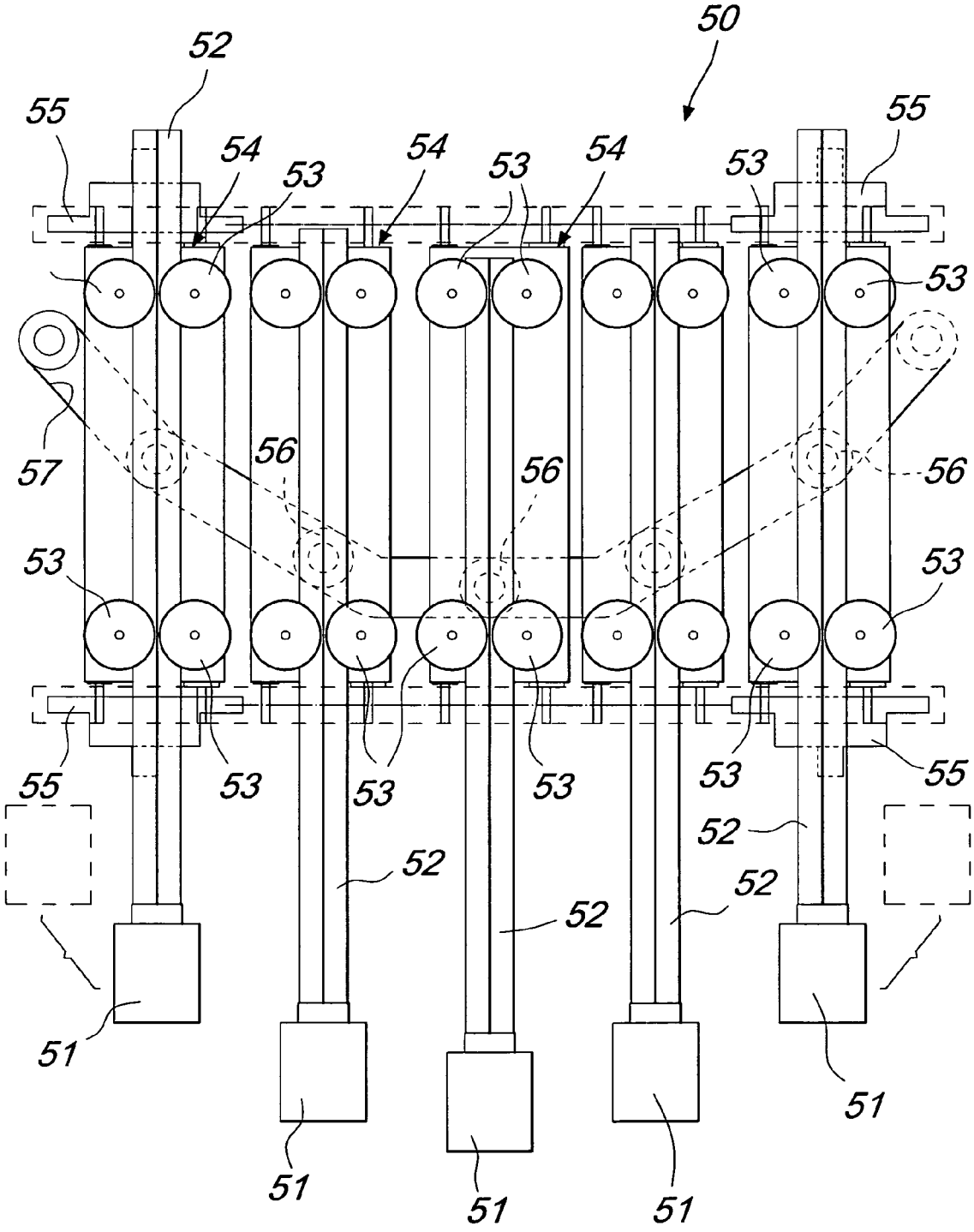
FIG. 6 is an elevated view of the tamping assembly.
Figure 8:
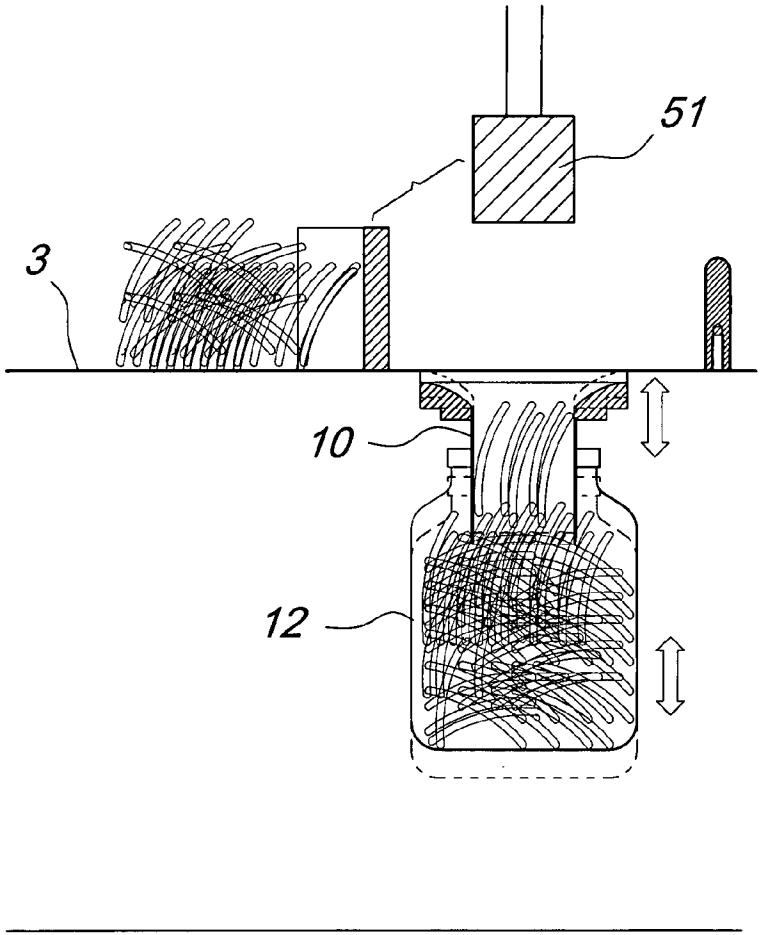
FIGS. 7, 8, 9 and 10 are schematic views in succession of the arrangement of the container, the insertion of the product with vibration within the container, the step for insertion and final packing, and the separation of the filled container.
Figure 7:
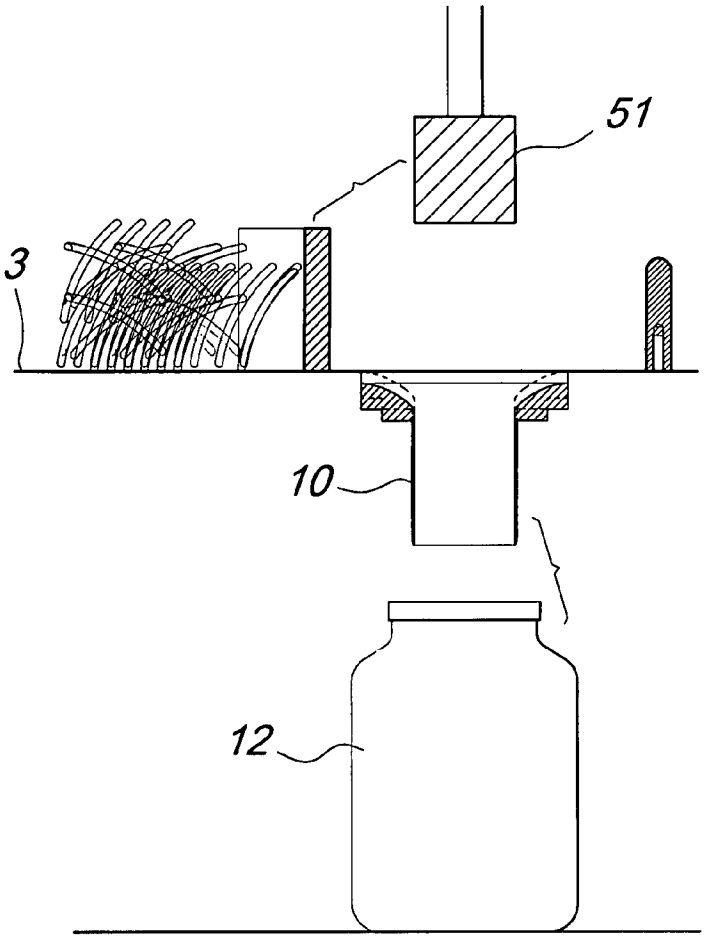
Figure 10:
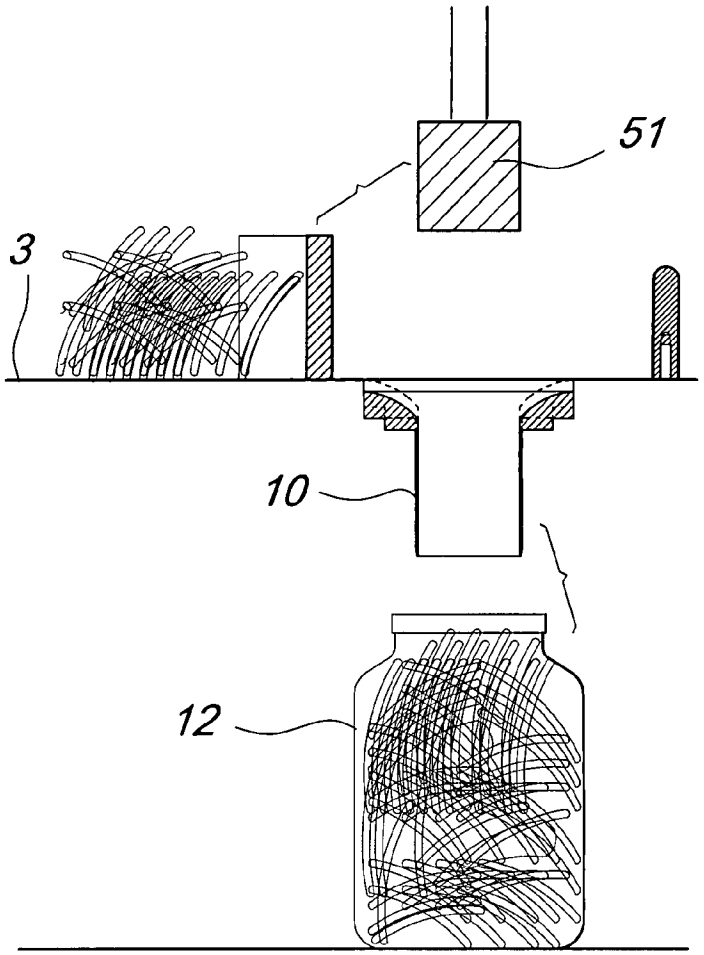
Figure 9:
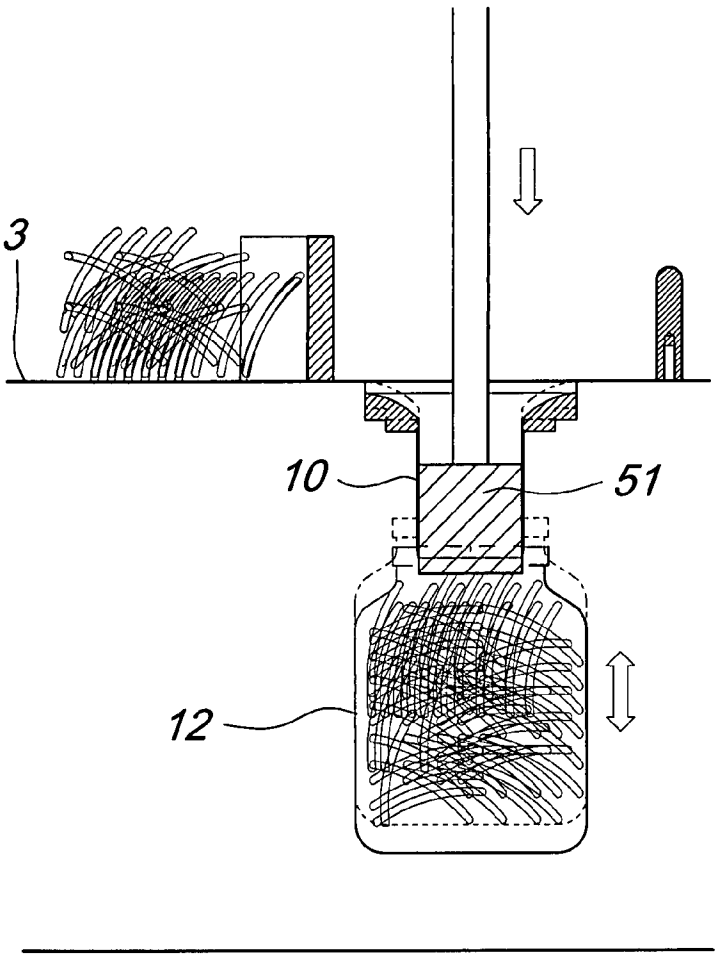

As shown in FIGS. 5 and 6, the tamping assembly 50 is constituted by a plurality of tamping elements or pads 51, each of which is connected to a stein 52 which is guided slidingly between pairs of rollers 53 of carriages 54, which carriages 54 are connected to one another in a chain and run on pairs of pulleys 55 which are positioned above the pan of the carousel.

A tamping element lifting roller 56 is arranged on the guiding stem 52 and engages a cam track 57, which produces the translational motion of the tamping element or pad in a vertical direction.

In practice, the pad, after the initial step of insertion of the product in the funnels and in the containers, is inserted gradually in the funnel until it packs the product inside the container, following for a certain extent the path of the funnels and of the container, after which, once the step for insertion and final packing of the product has been performed, the tamping elements rise again and exit from the container and from the funnel and then travel along the rectilinear portion of the closed extension of the chain of the tamping assembly, which in practice moves necessarily in step with the carousel, thanks to the fact that at least one tamping element is always inserted in a funnel.

Each tamping element of course has the same pitch as the holes where the funnels are provided and is jointly connected to a double chain which keeps the stem of the tamping assembly in a vertical position.

The profile of the chain in the internal region for return of the tamping elements is straight, whereas in the portion in which the pads are inserted in the funnels it is curved and corresponds to the path of the carousel.

The descent, insertion, exit and rise of the tamping element is generated by a cam track system which moves a roller which is jointly connected to the stem of the tamping element.

Compression of the tamping element in the container is adjusted by the vertical position of the cams.

Tamping occurs in the region where the product is not present on the filling holes, since it is located after the skimming of the brush at the pan lifting region, where the container has already moved slightly away from the funnel in order to allow the packing of the product also in the upper portion of the container.

From what has been described above it is evident that the invention achieves the proposed aim and objects, and in particular the fact is stressed that a circular filling machine is provided which is studied specifically for slender and elongated products and allows both to perform correct volumetric dosage thanks to the variation of the insertion of the funnel in the container and a precise insertion of the products in the container thanks to the tamping assembly, which performs insertion and final packing.

The invention thus conceived is susceptible of numerous modifications and variations, all of which are within the scope of the appended claims.

Moreover, all the details may be replaced with other technically equivalent elements.

In practice, the materials used, so long as they are compatible with the specific use, as well as the contingent shapes and dimensions, may be any according to requirements.

What is claimed is:

1. A circular filling machine particularly for slender and elongated products, comprising a carousel assembly which supports a plurality of filling funnels which can be inserted in corresponding containers supported by transfer pans, a vibration unit for said funnels, a vibration assembly for said transfer pans supporting said containers, and a tamping assembly for the insertion and final packing of the product in said containers, wherein said tamping assembly comprises a plurality of tamping elements which are connected to a stem which is guided slidingly between pairs of rollers defined by carriages, said carriages being connected to one another in a chain and said carriages running along pairs of pulleys which are arranged above a tray, for containing the product to be dosed, of said carousel, said carriages connected in a chain having at least one portion of the extent of their movement which coincides with the movement of said funnels.

2. The circular filling machine according to claim 1, wherein said vibration unit for said funnels comprise a cam with which rollers of each of the funnels engage, said rollers being connected by means of brackets to the funnels.

3. The circular filling machine according to claim 2, further comprising a support which is associated with the tray of said carousel to define a guide for a translational motion of said bracket.

4. The circular filling machine according to claim 1, wherein said vibration assembly for said transfer pans supporting the containers comprise a cam follower roller, which is associated with each pan and can engage a corresponding sector connected to said vibration assembly.

5. The circular filling machine according to claim 1, wherein said vibration unit for the funnels and said vibration assembly for the containers are independent of each other.

6. The circular filling machine according to claim 1, further comprising, on said stem, a tamping element lifting roller which can engage a cam track for the translational motion of said tamping element in a vertical direction.

* * * * *